US011242815B2

(12) United States Patent
Kobayashi et al.

(10) Patent No.: US 11,242,815 B2
(45) Date of Patent: Feb. 8, 2022

(54) ERROR DIAGNOSIS DEVICE AND ERROR DIAGNOSIS METHOD

(71) Applicant: ISUZU MOTORS LIMITED, Tokyo (JP)

(72) Inventors: Yuusuke Kobayashi, Fujisawa (JP); Katsushi Shidomi, Fujisawa (JP); Kunio Noda, Fujisawa (JP); Daiki Ishii, Fujisawa (JP); Fumihiko Okazaki, Tokyo (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 17/040,350

(22) PCT Filed: Mar. 20, 2019

(86) PCT No.: PCT/JP2019/011639
§ 371 (c)(1),
(2) Date: Sep. 22, 2020

(87) PCT Pub. No.: WO2019/181996
PCT Pub. Date: Sep. 26, 2019

(65) Prior Publication Data

US 2021/0087993 A1 Mar. 25, 2021

(30) Foreign Application Priority Data

Mar. 22, 2018 (JP) ..... JP2018-055187

(51) Int. Cl.
*F02D 41/22* (2006.01)
*F02D 1/02* (2006.01)
(Continued)

(52) U.S. Cl.
CPC ..... *F02D 41/22* (2013.01); *F02D 1/02* (2013.01); *F02D 41/40* (2013.01);
(Continued)

(58) Field of Classification Search
CPC . F02D 41/22; F02D 41/40; F02D 1/02; F02D 59/022; F02D 59/025; F02D 59/34; F02D 2041/224; F02D 2200/101
(Continued)

(56) References Cited

U.S. PATENT DOCUMENTS

2006/0021598 A1* 2/2006 Nomura ..... F02M 63/0225 123/446
2007/0246021 A1 10/2007 Takayanagi et al.
(Continued)

FOREIGN PATENT DOCUMENTS

CN 101063425 A 10/2007
CN 101063432 A 10/2007
(Continued)

OTHER PUBLICATIONS

JP2007032332A (Miyazaki et al.) (Feb. 8, 2007) (Machine Translation) Retrieved from Dialog on Jun. 7, 2021. (Year: 2007).*
(Continued)

*Primary Examiner* — Mahmoud Gimie

(57) ABSTRACT

The error diagnosis device has: an input unit that receives detected values for pressure inside the common rail; a calculation unit that, if the detected values are less than a target common rail pressure, calculates the pressure differences and the fuel pump discharge amounts; and a determination unit that determines whether or not a set time has lapsed in a state in which the pressure differences are at least a first threshold value and less than a second threshold value and the discharge amounts are at least a third threshold value and less than a fourth threshold value. The determination unit determines that an error has occurred in the high-pressure pump if the set time has lapsed and determines that an error has occurred in the flowrate adjustment valve if the set time has not lapsed.

3 Claims, 3 Drawing Sheets

(51) Int. Cl.

| | |
|---|---|
| ***F02M 59/02*** | (2006.01) |
| ***F02D 41/40*** | (2006.01) |
| ***F02M 59/34*** | (2006.01) |

(52) U.S. Cl.
CPC ..... *F02M 59/022* (2013.01); *F02M 59/025* (2013.01); *F02M 59/34* (2013.01); *F02D 2041/224* (2013.01); *F02D 2200/101* (2013.01)

(58) Field of Classification Search
USPC ..... 123/495
See application file for complete search history.

(56) References Cited

U.S. PATENT DOCUMENTS

| | | | |
|---|---|---|---|
| 2007/0251502 | A1 | 11/2007 | Takayanagi et al. |
| 2009/0063012 | A1 | 3/2009 | Nakata et al. |
| 2014/0053812 | A1 | 2/2014 | Kojima |

FOREIGN PATENT DOCUMENTS

| | | | | | |
|---|---|---|---|---|---|
| CN | 103502622 | A | | 1/2014 | |
| EP | 1371836 | A2 | | 12/2003 | |
| EP | 1971836 | A2 | | 12/2003 | |
| JP | 2004068810 | A | | 3/2004 | |
| JP | 2004108171 | A | | 4/2004 | |
| JP | 2007032332 | A | * | 2/2007 | ..... F02D 41/3094 |
| JP | 2007071067 | A | | 3/2007 | |
| JP | 2008291808 | A | | 12/2008 | |
| JP | 2009057928 | A | | 3/2009 | |
| JP | 2009138593 | A | | 6/2009 | |
| JP | 2011043122 | A | | 3/2011 | |
| JP | 2011196186 | A | | 10/2011 | |

OTHER PUBLICATIONS

International Search Report for International Application No. PCT/JP2019/011639; dated Jun. 11, 2019.
CNIPA Office Action for corresponding CN Application No. 201980019772.0; dated Sep. 22, 2021.

* cited by examiner

ERROR DIAGNOSIS DEVICE AND ERROR DIAGNOSIS METHOD

CROSS REFERENCE TO RELATED APPLICATIONS

This is the U.S. national stage of application No. PCT/JP2019/011639, filed on Mar. 20, 2019. Priority under 35 U.S.C. § 119(a) and 35 U.S.C. § 365(b) is claimed from Japanese Application No. 2018-055187, filed Mar. 22, 2018, the disclosure of which is also incorporated herein by reference.

TECHNICAL FIELD

The present disclosure relates to a malfunction diagnosis device for diagnosing a malfunction of a fuel pump and a method for diagnosing a malfunction of the fuel pump.

BACKGROUND ART

A conventional fuel supply system that supplies fuel stored in a fuel tank to the internal combustion engine side (for example, a common rail) is known (see, for example, Patent Literature (hereinafter referred to as "PTL") 1). In the fuel supply system, for example, the fuel pumped up from the fuel tank by a feed pump passes through a fuel filter, and after the flow rate is adjusted by a flow control valve, the fuel is pressurized and discharged to the internal combustion engine side by a high pressure pump.

CITATION LIST

Patent Literature

PTL 1

Japanese Patent Application Laid-Open No. 2009-057928

SUMMARY OF INVENTION

Technical Problem

When a malfunction occurs at the above described fuel pump, it is unfortunately necessary to disassemble and investigate the fuel pump to identify the location of the malfunction.

An object of the present disclosure is to provide a malfunction diagnosis device and a method for diagnosing a malfunction which are capable of identifying the location of the malfunction with no need of disassembly.

Solution to Problem

A malfunction diagnosis device according to an aspect of the present disclosure is for diagnosing a malfunction of a fuel pump that includes a flow control valve for adjusting a flow rate of fuel pumped up from a storage section, and a high pressure pump for pressurizing the fuel whose flow rate is adjusted and discharging the fuel to a pressure accumulator section, the malfunction diagnosis device including: an input section that receives a detected value of a pressure of the fuel in the pressure accumulator section; a calculation section that calculates, when the detected value is less than a target value of the pressure, a differential pressure between the target value and the detected value, and a discharge amount of the fuel discharged from the fuel pump; and a determination section that determines whether a preset time has passed in a state where the differential pressure is equal to or more than a first threshold value and less than a second threshold value while the discharge amount is equal to or more than a third threshold value and less than a fourth threshold value, in which the determination section determines that a malfunction has occurred at the high pressure pump, when the preset time passes, and a malfunction has occurred at the flow control valve, when the preset time does not pass.

A method for diagnosing a malfunction according to an aspect of the present disclosure is a method for diagnosing a malfunction of a fuel pump that includes a flow control valve for adjusting a flow rate of fuel pumped up from a storage section, and a high pressure pump for pressurizing the fuel whose flow rate is adjusted and discharging the fuel to a pressure accumulator section, the method including: receiving a detected value of a pressure of the fuel in the pressure accumulator section; calculating, when the detected value is less than a target value of the pressure, a differential pressure between the target value and the detected value, and a discharge amount of the fuel discharged from the fuel pump; determining whether a preset time has passed in a state where the differential pressure is equal to or more than a first threshold value and less than a second threshold value while the discharge amount is equal to or more than a third threshold value and less than a fourth threshold value; and determining that a malfunction has occurred at the high pressure pump, when the preset time passes, and determining that a malfunction has occurred at the flow control valve, when the preset time does not pass.

Advantageous Effects of Invention

The present disclosure is capable of identifying the location of a malfunction with no need of disassembly.

DESCRIPTION OF EMBODIMENTS

Hereinafter, embodiments of the present disclosure will be described in detail with reference to the drawings.

A configuration of fuel supply system 1 and malfunction diagnosis device 100 according to an embodiment of the present disclosure will be described with reference to FIG. 1.

Figure 1:
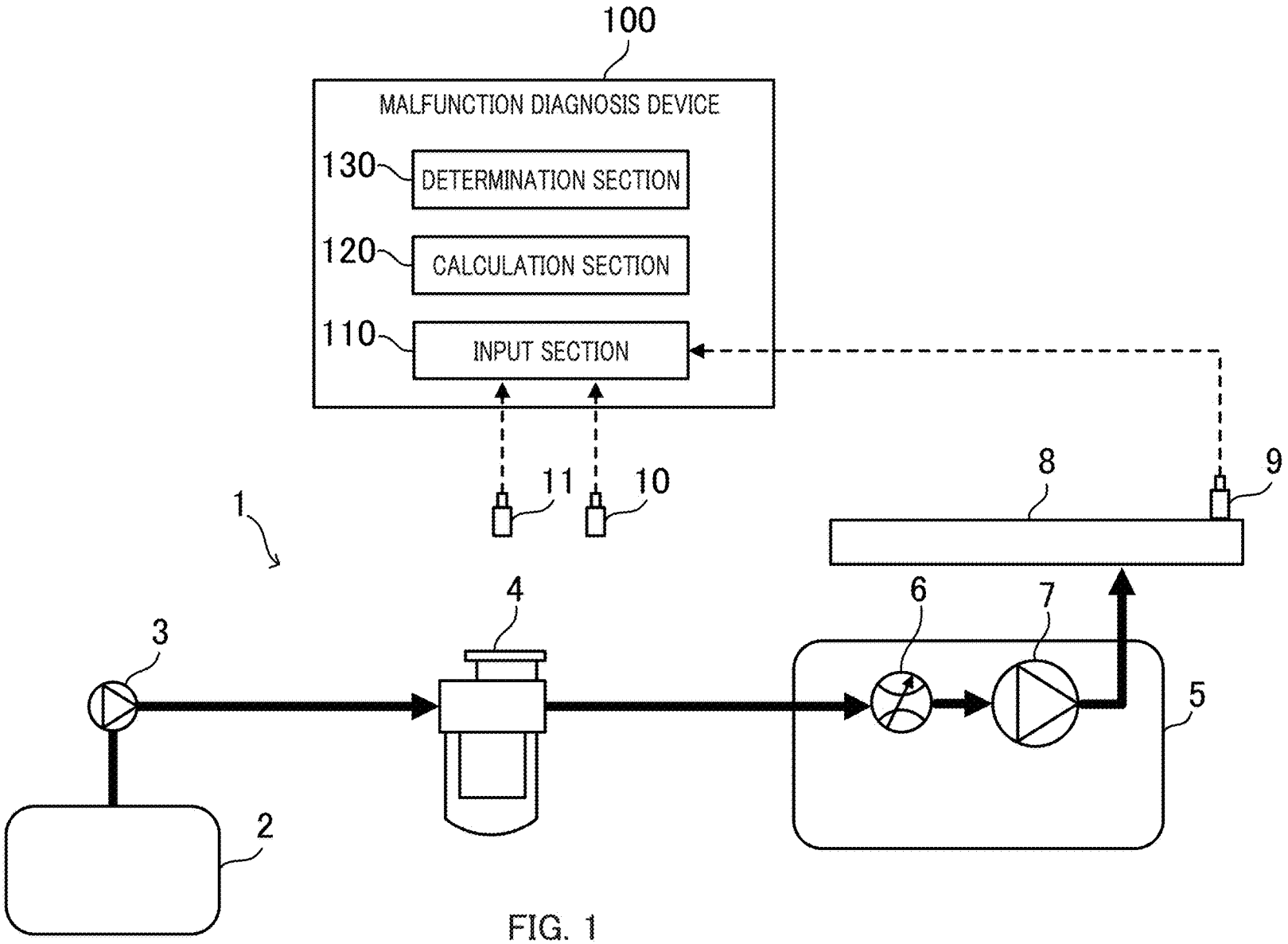
FIG. 1 illustrates an exemplary configuration of a fuel supply system and a malfunction diagnosis device according to an embodiment of the present disclosure.

FIG. 1 illustrates an exemplary configuration of fuel supply system 1 and malfunction diagnosis device 100. In FIG. 1, the solid arrows show the flow of fuel and the broken arrows show the flow of electrical signals.

Fuel supply system 1 and malfunction diagnosis device 100 illustrated in FIG. 1 are mounted on a vehicle provided with an internal combustion engine (for example, a diesel engine) driven by fuel (for example, light oil). Fuel supply system 1 is for supplying fuel to the internal combustion engine, and malfunction diagnosis device 100 is for identifying the occurrence of a malfunction and the location of the malfunction in fuel pump 5 of fuel supply system 1.

The configuration of fuel supply system 1 will now be described.

Fuel supply system 1 includes fuel tank 2 for storing fuel (an example of a storage section), feed pump 3 for pumping up the fuel from fuel tank 2, fuel filter 4 for collecting foreign matters contained in the fuel, and fuel pump 5 for discharging the fuel to common rail 8.

Fuel pump 5 includes flow control valve 6 for adjusting the flow rate of the fuel, and high pressure pump 7 for pressurizing the fuel until the fuel has a high pressure.

The opening of flow control valve 6 is controlled by a not-illustrated control device (for example, electric control unit or ECU) so that the pressure (common rail pressure) of the fuel stored in common rail 8 becomes a target common rail pressure determined based on the operating condition (for example, the rotation speed of the internal combustion engine and the accelerator opening).

High pressure pump 7 includes a plurality of plungers (not illustrated) that reciprocate in pump cylinders.

Common rail 8 (an example of a pressure accumulator) is provided with pressure sensor 9 for detecting the above described common rail pressure and outputting a value indicating the detected common rail pressure (hereinafter, referred to as a detected pressure value) to malfunction diagnosis device 100 as needed.

FIG. 1 illustrates a configuration with feed pump 3 provided on the upstream side of fuel filter 4, but the present embodiment is not limited to the configuration, and feed pump 3 may be provided, for example, at fuel pump 5.

A fuel filter different from fuel filter 4 may be provided on the upstream side of fuel filter 4 (for example, between fuel tank 2 and feed pump 3) in the configuration illustrated in FIG. 1.

In the fuel supply system 1 configured as described above, fuel stored in fuel tank 2 is pumped up by feed pump 3, and after foreign matters are collected by fuel filter 4, the fuel flows into fuel pump 5. The fuel whose flow rate is adjusted by flow control valve 6 based on the operating condition of the internal combustion engine is pressurized to have a high pressure by high pressure pump 7 and discharged to common rail 8. The fuel stored in common rail 8 is supplied to the injector (not illustrated) of the internal combustion engine and is injected into the combustion chamber by the injector.

The configuration of malfunction diagnosis device 100 will now be described.

Malfunction diagnosis device 100 includes input section 110, calculation section 120 and determination section 130.

Malfunction diagnosis device 100 includes, for example, a central processing unit (CPU), a storage medium such as a read only memory (ROM) that stores control programs, a working memory such as a random access memory (RAM), and a communication circuit, although they are not illustrated in the drawings. The function of calculation section 120 and determination section 130 described below is realized by the CPU executing a computer program.

Input section 110 receives the detected pressure value from pressure sensor 9 as needed.

Input section 110 also receives a detected angle value from crank angle sensor 10 as needed. The detected angle value indicates an angle of a crankshaft (not illustrated) of an internal combustion engine detected by crank angle sensor 10.

Input section 110 further receives a detected opening value from accelerator opening sensor 11 as needed. The detected opening value indicates the amount of depression of a gas pedal (not illustrated) detected by accelerator opening sensor 11.

When determination section 130 (described below) determines that the detected pressure value is less than a target common rail pressure, calculation section 120 calculates a differential pressure between the target common rail pressure and the detected pressure value (hereinafter, simply referred to as a differential pressure), and the amount of fuel discharged from fuel pump 5 (hereinafter referred to as the discharge amount).

Input section 110 may receive the target common rail pressure from another device (for example, an ECU), or calculation section 120 may calculate the target common rail pressure. The calculation by calculation section 120 is, for example, as follows. Calculation section 120 calculates the rotation speed of the internal combustion engine based on the detected angle value, and identifies a target common rail pressure corresponding to the calculated rotation speed of the internal combustion engine and the detected accelerator opening from the map in which target common rail pressures are given according to rotation speeds of the internal combustion engine and accelerator openings.

The calculation process of the discharge amount is performed as follows. For example, calculation section 120 calculates the rotation speed of the internal combustion engine based on the detected opening value. Calculation section 120 then identifies a target injection amount (the unit is, for example, $mm^3/st$) corresponding to the rotation speed of the internal combustion engine calculated as described above and the detected opening value from the map in which target injection amounts are given according to rotation speeds of the internal combustion engine and accelerator openings. Calculation section 120 then calculates the discharge amount (unit is, for example, $mm^3/sec$) by the equation: (target injection amount)×(rotation speed of internal combustion engine).

Hereinafter, the differential pressure calculated by calculation section 120 is referred to as "calculated differential pressure" and the discharge amount calculated by calculation section 120 is referred to as "calculated discharge amount."

Determination section 130 determines whether the detected pressure value is less than the target common rail pressure. When the detected pressure value is less than the target common rail pressure, determination section 130 instructs calculation section 120 to calculate the differential pressure and the discharge amount.

Determination section 130 also determines whether a preset time (hereinafter, referred to as set time) passes while the calculated differential pressure and the calculated discharge amount are within a preset range (hereinafter, referred to as set range).

Figure 2:
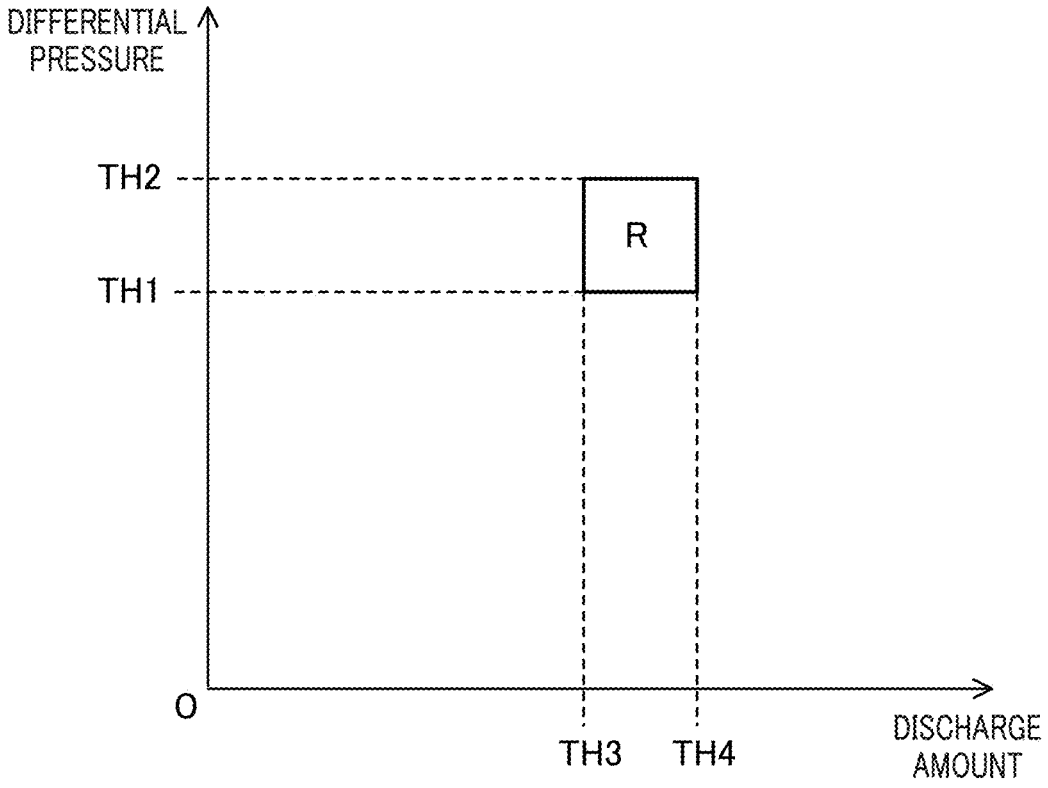
FIG. 2 illustrates an exemplary set range according to the embodiment of the present disclosure.

An exemplary set range will now be described with reference to FIG. 2. FIG. 2 illustrates an example of a set range. In FIG. 2, the abscissa represents the discharge amount and the ordinate represents the differential pressure.

Set range R in FIG. 2 includes a differential pressure equal to or more than threshold value TH1 (an example of the first threshold value) and less than threshold value TH2 (an example of the second threshold value), and a discharge amount equal to or more than threshold value TH3 (an example of the third threshold value) and less than threshold value TH4 (an example of the fourth threshold value).

Threshold value TH1 is, for example, an upper limit value of the differential pressure when all of the plungers provided in the high pressure pump are operating normally.

The threshold value TH2 is, for example, an upper limit value of the differential pressure when at least one of the plungers is operating normally and at least one of the plungers is broken.

The threshold value TH3 is, for example, a lower limit of the maximum dischargeable amount of the high pressure pump when at least one of the plungers is operating normally and at least one of the plungers is broken.

The threshold value TH4 is, for example, a lower limit of the maximum dischargeable amount of the high pressure pump when all of the plungers are operating normally.

The above described thresholds TH1 to TH4 are set based on the results of experiments, simulations and the like performed in advance.

This is the end of the description for the set range. Hereinafter, the description returns to FIG. 1.

Determination section 130 determines that a malfunction has occurred at high pressure pump 7 of fuel pump 5 when the set time passes, while the calculated differential pressure and the calculated discharge amount are within the set range. The malfunction in high pressure pump 7 means that at least one of the plungers of high pressure pump 7 is broken.

On the other hand, determination section 130 determines that a malfunction has occurred at flow control valve 6 of fuel pump 5 when the set time does not pass, while the calculated differential pressure and the calculated discharge amount are within the set range.

Determination section 130 outputs or wirelessly transmits diagnostic result information indicating a location where the malfunction occurs (flow control valve 6 or high pressure pump 7) to a predetermined device.

The predetermined device may be, for example, a display device or a storage device mounted on the vehicle, or a server device installed outside the vehicle.

The diagnostic result information output to the storage device or the server device is used by, for example, the manufacturer of the device in which the malfunction occurs, or the repairer who repairs or replaces the device in which the malfunction occurs. When the predetermined device is a server device, for example, the diagnostic result information is transmitted from the server device to a terminal of the repairer, and thus the repairer can understand the location of the malfunction before the vehicle to be repaired is brought in.

This is the end of the description for fuel supply system 1 and malfunction diagnosis device 100.

Figure 3:
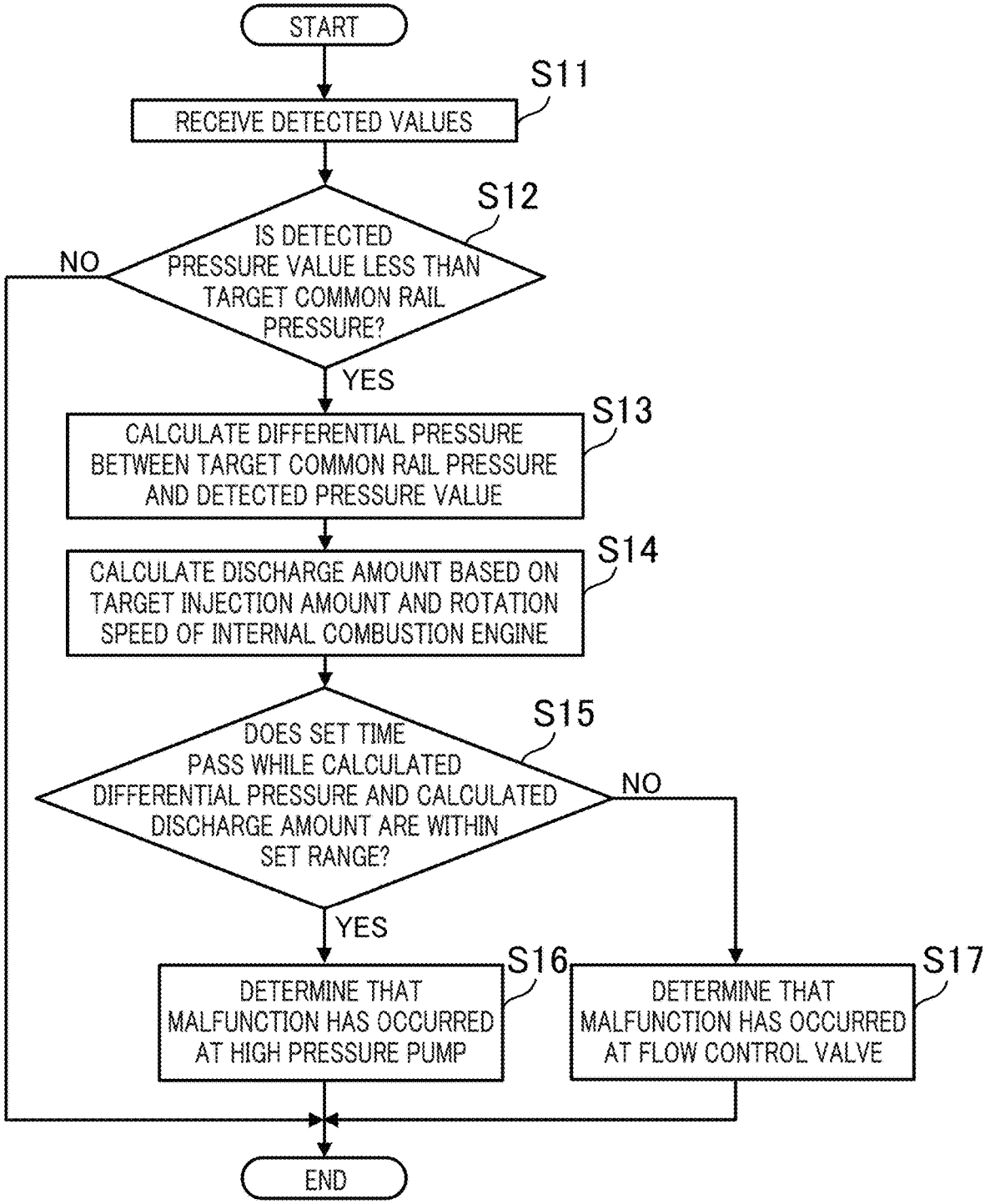
FIG. 3 illustrates an exemplary operation of the malfunction diagnosis device according to the embodiment of the present disclosure.

The operation of malfunction diagnosis device 100 will now be described with reference to FIG. 3. FIG. 3 illustrates an exemplary operation of malfunction diagnosis device 100.

Input section 110 receives detected values (step S11). As described above, input section 110 receives, for example, a detected pressure value from pressure sensor 9, a detected angle value from crank angle sensor 10, and a detected opening value from accelerator opening sensor 11.

Determination section 130 then determines whether the detected pressure value is less than a target common rail pressure (step S12).

When the detected pressure value is equal to or more than the target common rail pressure (step S12: NO), the flow ends.

On the other hand, when the detected pressure value is less than the target common rail pressure (step S12: YES), determination section 130 instructs calculation section 120 to calculate a differential pressure and a discharge amount.

Calculation section 120 calculates a differential pressure between the target common rail pressure and the detected pressure value (step S13).

Calculation section 120 then calculates a discharge amount based on a target injection amount and a rotation speed of the internal combustion engine (step S14).

In this embodiment, the discharge amount is calculated after the calculation of the differential pressure as an example, but the differential pressure may be calculated after the discharge amount is calculated.

Determination section 130 then determines whether a set time passes while the calculated differential pressure and the calculated discharge amount are within a set range (step S15).

When the set time passes while the calculated differential pressure and the calculated discharge amount are within the set range (step S15: YES), determination section 130 determines that a malfunction has occurred at high pressure pump 7 (step S16). The malfunction in high pressure pump 7 means that at least one plunger is broken as described above.

On the other hand, when the set time does not pass while the calculated differential pressure and the calculated discharge amount are within the set range (step S15: NO), determination section 130 determines that a malfunction has occurred at flow control valve 6 (step S17).

Determination section 130 then outputs or wirelessly transmits the diagnostic result information indicating the determination result to a predetermined device.

This is the end of the description for the operation of malfunction diagnosis device 100.

As described in detail above, malfunction diagnosis device 100 of the present embodiment determines whether a set time has passed in a state where a differential pressure between the target common rail pressure and the detected pressure value is equal to or more than a first threshold value and less than a second threshold value while a discharge amount of the fuel pump is equal to or more than a third threshold value and less than a fourth threshold value. Malfunction diagnosis device 100 determines that a malfunction has occurred at the high pressure pump when the set time passes, and that a malfunction has occurred at the flow control valve when the set time does not pass, while the differential pressure and the discharge amount are within the range. When a malfunction occurs in fuel pump 5, disassembling of fuel pump 5 is unnecessary for the investigation, and thus the location of the malfunction in fuel pump 5 can be identified without excessive time and cost.

The present disclosure is not limited to the above described embodiment, and may be appropriately modified and implemented without departing from the spirit of the present disclosure. Hereinafter, a modification will be described.

The embodiment describes malfunction diagnosis device 100 mounted on a vehicle as an example, but malfunction diagnosis device 100 may be provided outside the vehicle.

For example, a wireless communication device mounted on a vehicle (for example, a device used in telematics) wirelessly transmits detected values (for example, a detected pressure value, a detected angle value and a detected opening value) to malfunction diagnosis device 100 via a predetermined network in this modification. Malfunction diagnosis device 100 uses the detected values received to perform the above described calculation process and the determination processes.

INDUSTRIAL APPLICABILITY

The malfunction diagnosis device and the method for diagnosing a malfunction of the present disclosure are particularly advantageous for the identification of the location of the malfunction in a fuel pump.

The invention claimed is:

1. A malfunction diagnosis device for diagnosing a malfunction of a fuel pump that includes a flow control valve for adjusting a flow rate of fuel pumped up from a storage section, and a high pressure pump for pressurizing the fuel whose flow rate is adjusted and discharging the fuel to a pressure accumulator section, the malfunction diagnosis device comprising:

an input section that receives a detected value of a pressure of the fuel in the pressure accumulator section;

a calculation section that calculates, when the detected value is less than a target value of the pressure, a differential pressure between the target value and the detected value, and a discharge amount of the fuel discharged from the fuel pump; and a determination section that determines whether a preset time has passed in a state where the differential pressure is equal to or more than a first threshold value and less than a second threshold value while the discharge amount is equal to or more than a third threshold value and less than a fourth threshold value, wherein the determination section determines that:

a malfunction has occurred at the high pressure pump, when the preset time passes, and a malfunction has occurred at the flow control valve, when the preset time does not pass, and wherein the first threshold value is an upper limit value of the differential pressure when all of plungers provided in the high pressure pump operate normally;

the second threshold value is an upper limit value of the differential pressure when at least one of the plungers operates normally and at least one of the plungers is broken;

the third threshold value is a lower limit of a maximum dischargeable amount of the high pressure pump when at least one of the plungers operates normally and at least one of the plungers is broken; and the fourth threshold value is a lower limit of a maximum dischargeable amount of the high pressure pump when all of the plungers operate normally.

2. The malfunction diagnosis device according to claim 1, wherein:

the calculation section calculates the discharge amount based on a target injection amount of an injector that injects the fuel supplied from the pressure accumulator section, and a rotation speed of an internal combustion engine.

3. A method for diagnosing a malfunction of a fuel pump that includes a flow control valve for adjusting a flow rate of fuel pumped up from a storage section, and a high pressure pump for pressurizing the fuel whose flow rate is adjusted and discharging the fuel to a pressure accumulator section, the method comprising:

receiving a detected value of a pressure of the fuel in the pressure accumulator section;

calculating, when the detected value is less than a target value of the pressure, a differential pressure between the target value and the detected value, and a discharge amount of the fuel from the fuel pump;

determining whether a preset time has passed in a state where the differential pressure is equal to or more than a first threshold value and less than a second threshold value while the discharge amount is equal to or more than a third threshold value and less than a fourth threshold value; and determining that a malfunction has occurred at the high pressure pump, when the preset time passes, and determining that a malfunction has occurred at the flow control valve, when the preset time does not pass, wherein the first threshold value is an upper limit value of the differential pressure when all of plungers provided in the high pressure pump operate normally;

the second threshold value is an upper limit value of the differential pressure when at least one of the plungers operates normally and at least one of the plungers is broken;

the third threshold value is a lower limit of a maximum dischargeable amount of the high pressure pump when at least one of the plungers operates normally and at least one of the plungers is broken; and the fourth threshold value is a lower limit of a maximum dischargeable amount of the high pressure pump when all of the plungers operate normally.

* * * * *